US008047975B1

(12) United States Patent
Chen

(10) Patent No.: US 8,047,975 B1
(45) Date of Patent: Nov. 1, 2011

(54) DUMBBELL ASSEMBLY WITH ROTATABLE WEIGHT MEMBERS

(76) Inventor: Jih-Ming Chen, Taichung County (TW)

( * ) Notice: Subject to any disclaimer, the term of this patent is extended or adjusted under 35 U.S.C. 154(b) by 0 days.

(21) Appl. No.: 12/883,589

(22) Filed: Sep. 16, 2010

(51) Int. Cl.
*A63B 21/00* (2006.01)

(52) U.S. Cl. ..... 482/108; 482/110; 482/104

(58) Field of Classification Search ..... 482/110, 482/104–108; 46/52
See application file for complete search history.

(56) References Cited

U.S. PATENT DOCUMENTS

| | | | | |
|---|---|---|---|---|
| 1,333,005 | A * | 3/1920 | Warner | 482/110 |
| 4,252,316 | A * | 2/1981 | Price | 482/106 |
| 4,531,729 | A * | 7/1985 | Wrinkle | 482/106 |
| 6,663,542 | B1 * | 12/2003 | Trabbic | 482/106 |
| 6,776,742 | B2 * | 8/2004 | Domenge | 482/110 |

* cited by examiner

*Primary Examiner* — Jerome W Donnelly

(57) ABSTRACT

A dumbbell assembly includes at least one bar and a disk is fixedly connected to the at least one bar. The disk has a reception portion. A rotatable unit is engaged with the reception portion of the disk. An arm has an insertion which is connected to the rotatable unit and a disk is connected to the arm. At least one weight member is connected to the wing. The user holds the at least one bar and operates the dumbbell assembly, the wing together with the weight member are rotated about the at least one bar to generate centrifugal forces which exercise the user's muscles.

10 Claims, 8 Drawing Sheets

DUMBBELL ASSEMBLY WITH ROTATABLE WEIGHT MEMBERS

FIELD OF THE INVENTION

The present invention relates to a dumbbell assembly, and more particularly, to a dumbbell with rotatable weight members on two ends thereof.

BACKGROUND OF THE INVENTION

A conventional dumbbell assembly 60 is shown in FIG. 8 and generally includes a bar 61 and multiple disk-like weight members 62 connected to two ends of the bar 61. The bar 61 includes two threaded ends 611 and the weight members 62 are mounted to the two threaded ends 611 and two nuts 612 are respectively and threadedly connected to the two threaded ends 611 to fix the weight members 62.

The conventional dumbbell can be used to exercise the muscles by the assembly of the bar and the weight members, however, the dumbbell assembly can only be used to lift it up and down, which is so boring and the users easily give up.

The present invention intends to provide a dumbbell assembly which includes two disks rotatably connected to two ends of the bar and each disk is optionally connected to at least one weight member. The weight members are eccentrically connected to the disks so that when using the dumbbell assembly, the wings rotate to apply centrifugal forces to the user's muscles.

SUMMARY OF THE INVENTION

The present invention relates to a dumbbell assembly and comprises at least one bar and a disk is fixed to the at least one bar and has a reception portion in which a rotatable unit is received. An arm has an insertion on a first end thereof and the insertion is mounted to the rotatable unit. The arm has at least one wing and at least one weight member is connected to the wing of the arm.

The primary object of the present invention is to provide a dumbbell assembly wherein the wing of the arm is rotated relative to the bar so that the wing together with the weight member are rotated to generate centrifugal forces which exercise the user's muscles.

Another object of the present invention is to provide a dumbbell assembly wherein the disk can be perpendicularly or horizontally connected to the bar so as to obtain forces in different directions when using the dumbbell assembly.

Yet another object of the present invention is to provide a dumbbell assembly wherein the weight members are securely connected to the wing by bolts to ensure the safety operation of the users.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
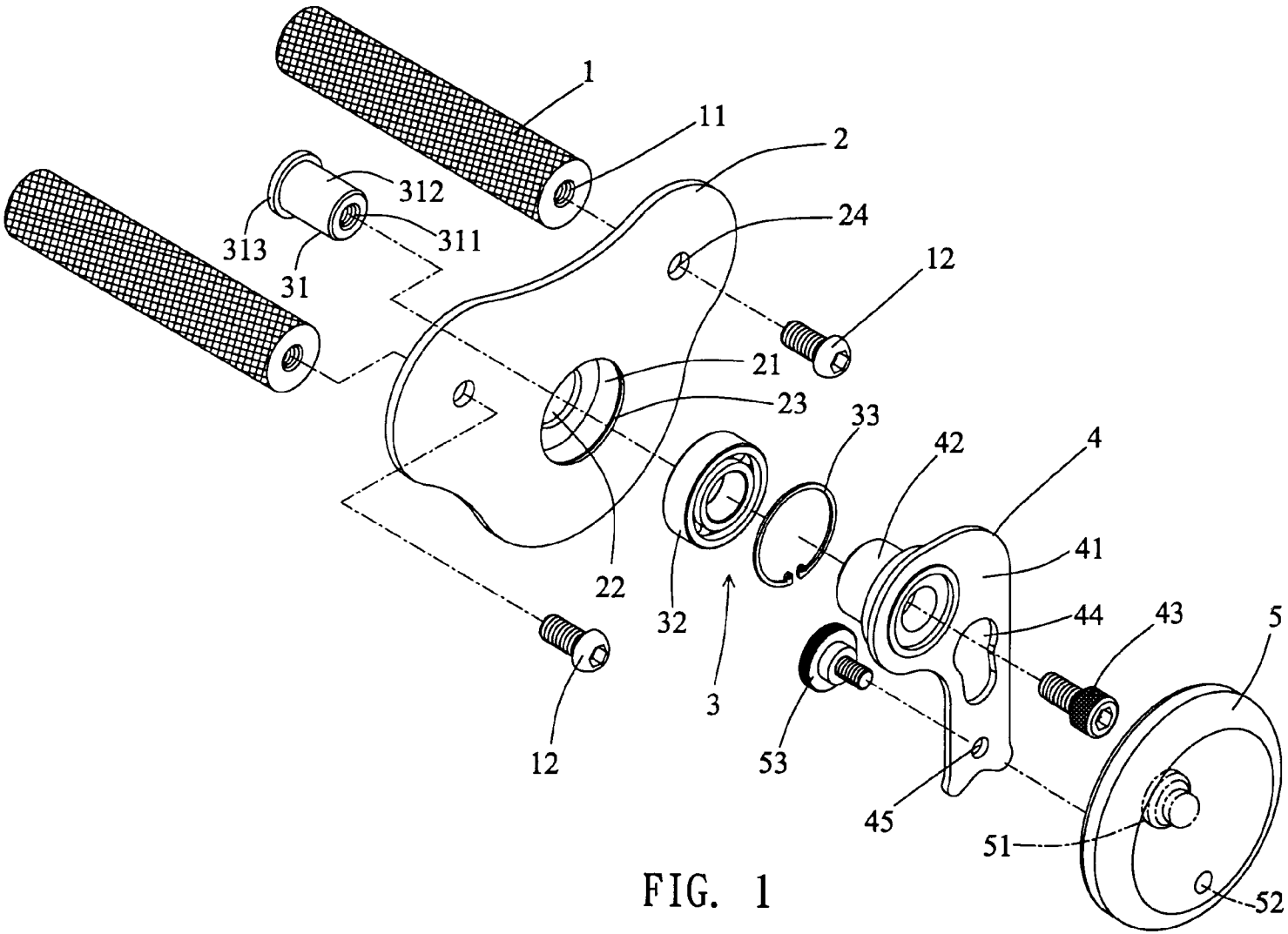
FIG. 1 is an exploded view to show the dumbbell assembly of the present invention.
Figure 2:
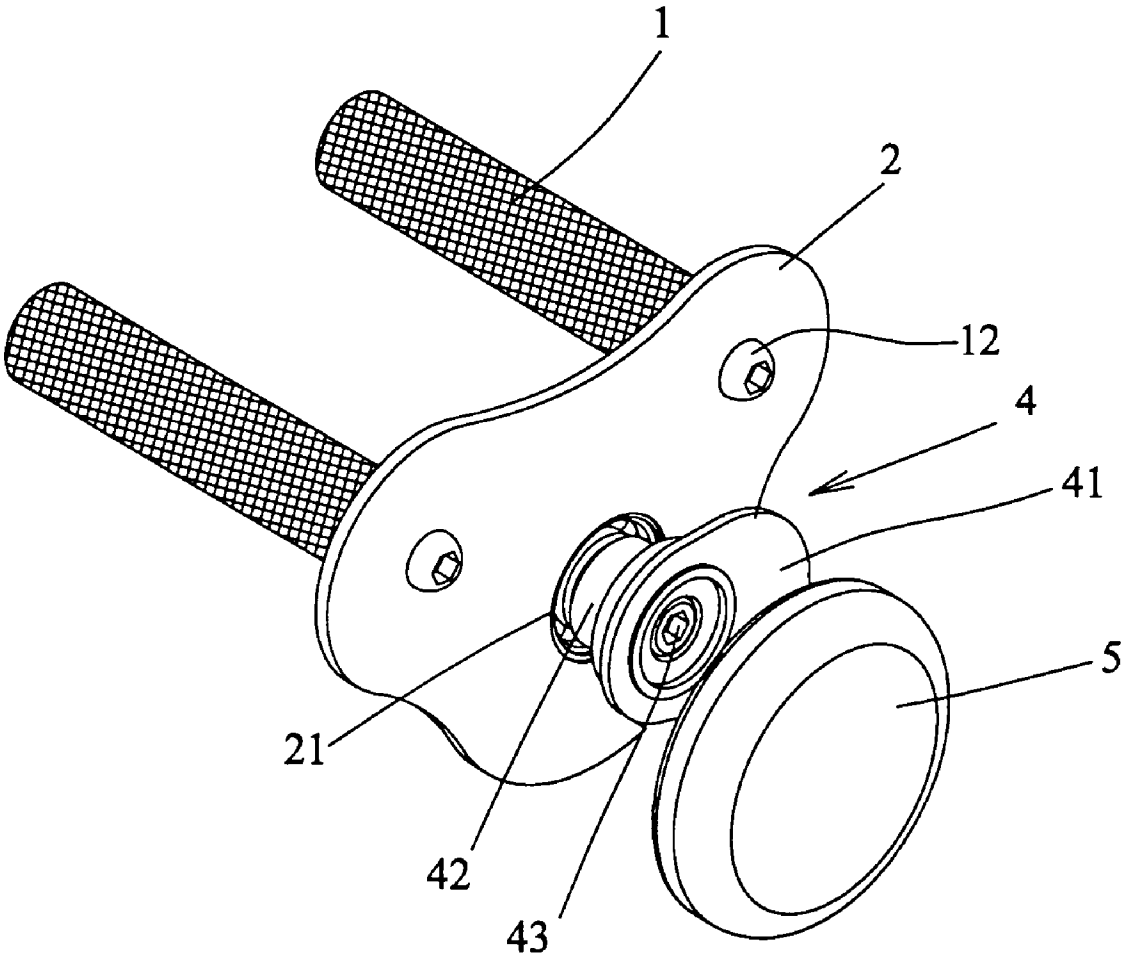
FIG. 2 is a perspective view to show the dumbbell assembly of the present invention.
Figure 3:
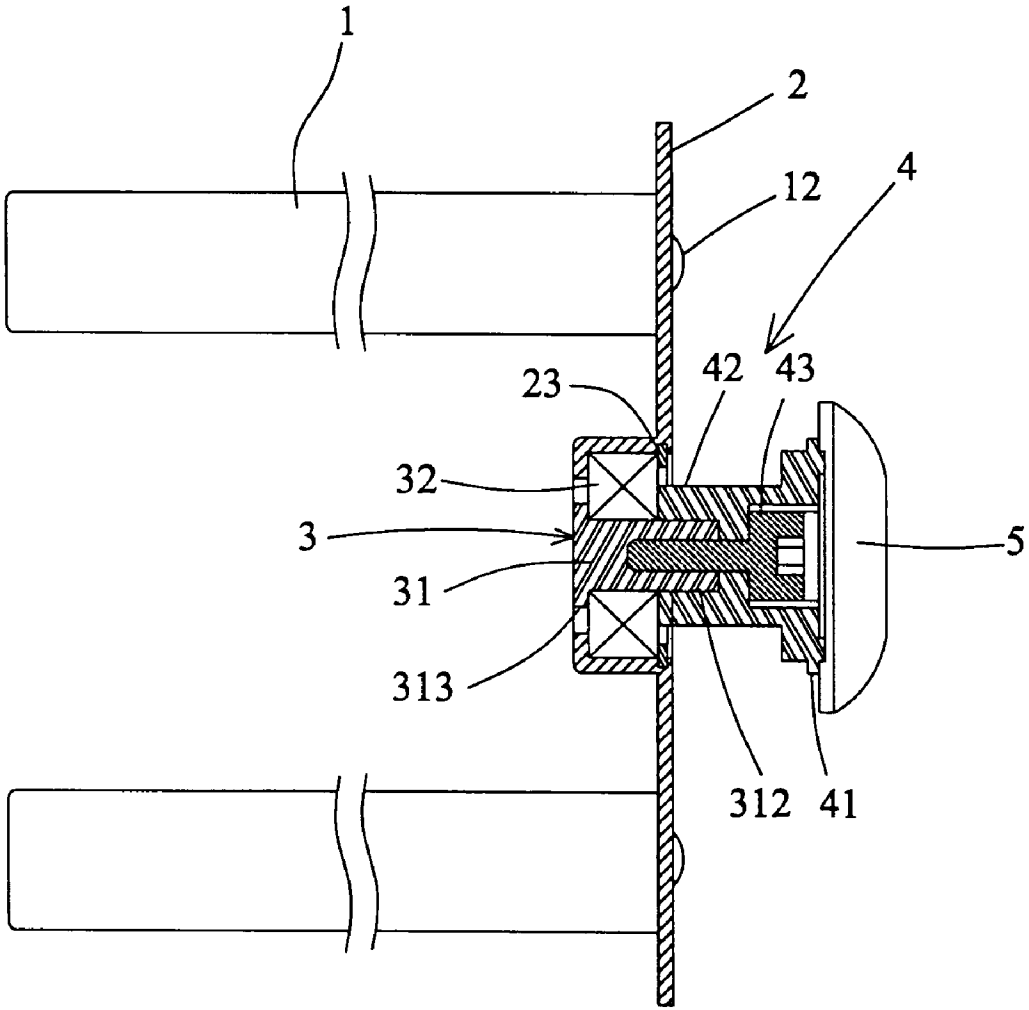
FIG. 3 is a cross sectional view of the dumbbell assembly of the present invention.

Referring to FIGS. 1 to 3, the dumbbell assembly of the present invention comprises at least one bar 1, in this embodiment, there are two bars 1 and each bar 1 has a connection portion 11 at a distal end thereof. The connection portion 11 has a threaded hole defined therein. A disk 2 has two apertures 24 defined therethrough and two bolts 12 extend through the two apertures 24 and are fixed to the two respective threaded holes in the two connection portions 11. The disk 2 has a reception portion 21 and a through hole 22 is defined through the reception portion 21. An annular groove 23 is defined in an inner periphery of the through hole 22.

A rotatable unit 3 is engaged with the reception portion 21 of the disk 2 and comprises a connector 31, a bearing 32 and a clip 33. The connector 31 comprises a tubular portion 312 and a flange 313 extends radially from a first end of the tubular portion 312. A connection hole 311 is defined in a second end of the tubular portion 312. The bearing 32 is securely engaged with the through hole 22 of the reception portion 21 of the disk 2 and the tubular portion 312 of the connector 31 securely extends through the bearing 32. The flange 313 contacts against the bearing 32 and, the clip 33 is engaged with the annular groove 23 to position the bearing 32.

An arm 4 has an insertion 42 on a first end thereof and the insertion 42 is mounted to the tubular portion 312 of the connector 31. The arm 4 has a wing 41 connected thereto and the wing 41 has an engaging hole 44 and a aperture 45. At least one weight member 5 is connected to the engaging hole 44. A bolt 43 extends through the insertion 42 and is connected to the connection hole 311 of the connector 31. Therefore, the arm 4 is rotatable by the bearing 32 and one side of the wing 41 contacts the bearing 32.

The at least one weight member 5 has a protrusion 51 at a center of on side thereof and a connection aperture 52 is located at a distance from the protrusion 51. The protrusion 51 is engaged with the engaging hole 44 of the wing 41 and a bolt 53 extends through the aperture 45 in the wing 41 and is connected to the connection aperture 52 of the at least one weight member 5.

Figure 4:
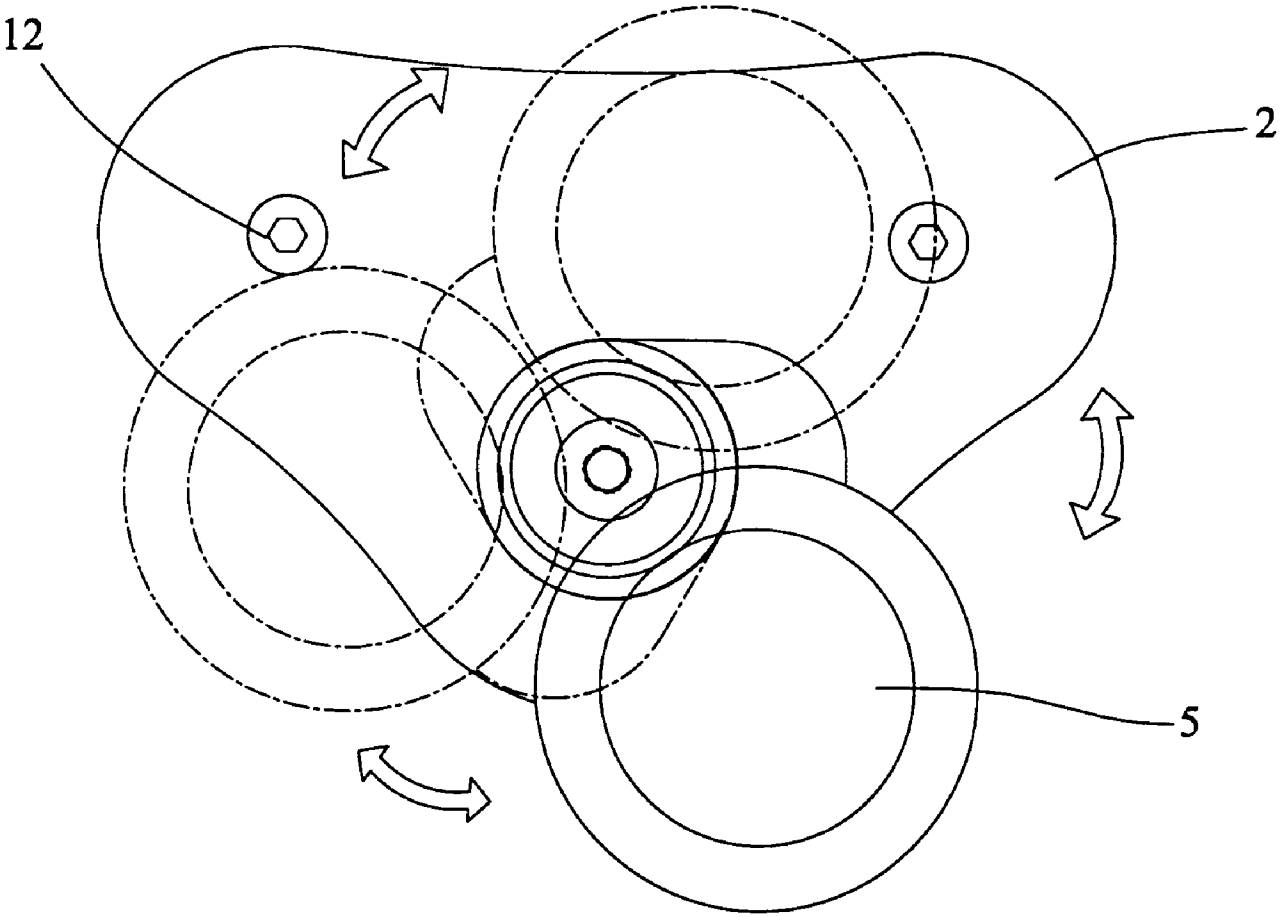
FIG. 4 shows that the wing is rotated relative to the bar.

It is noted that the reception portion 21 is located such that the two respective extension lines of the bars 1 do not pass through the center of the reception portion. The weight member 5 engaged with the engaging hole 44 is also located at a distance from the insertion 42. Therefore, referring to FIGS. 2 to 4, when the user holds the bars 1 and rotate the dumbbell assembly, the at least one weight member 5 is rotated about the insertion 42, the user is applied a centrifugal force to his muscles which are then exercised.

Figure 5:
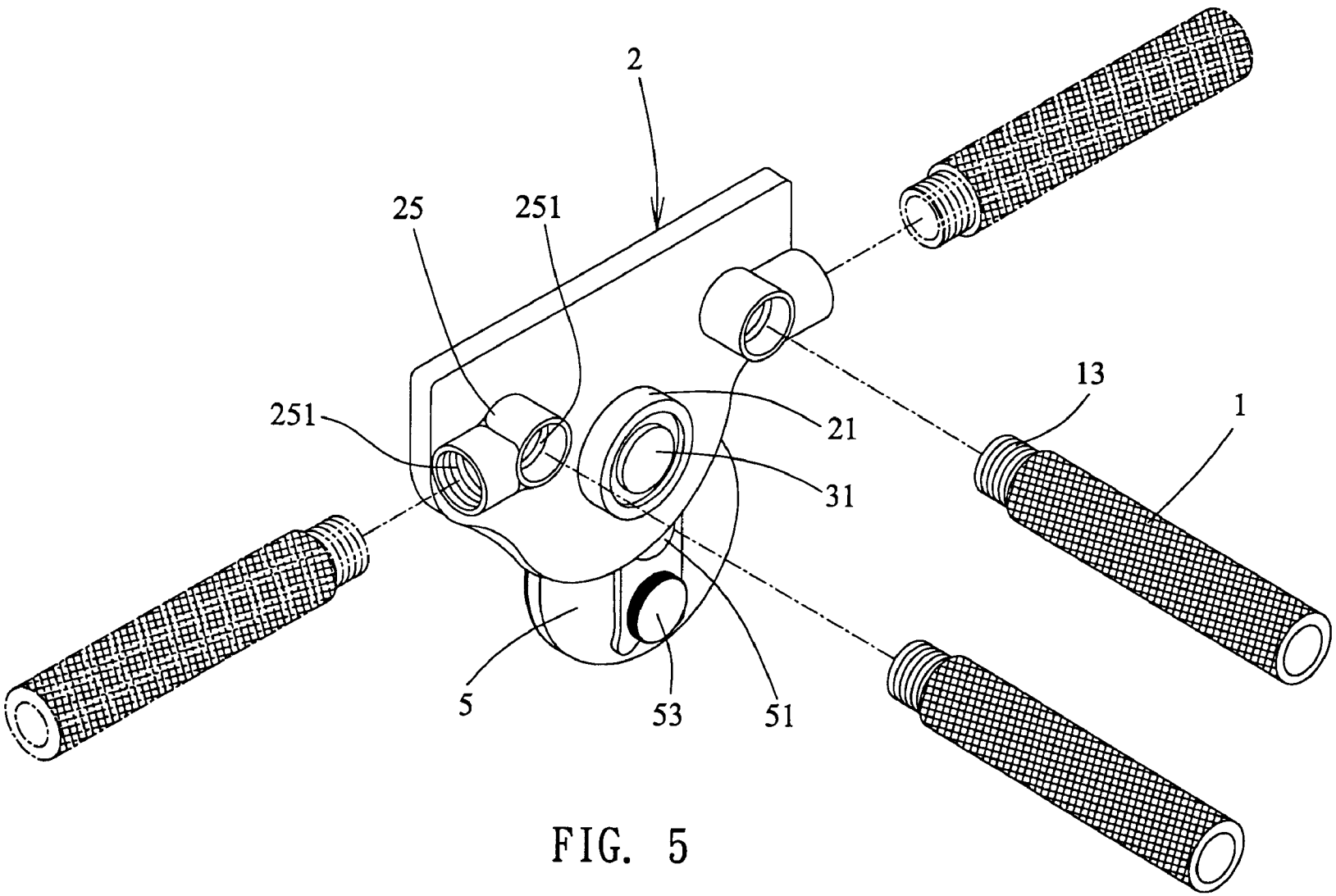
FIG. 5 is an exploded view to show another embodiment of the dumbbell assembly of the present invention.
Figure 6:
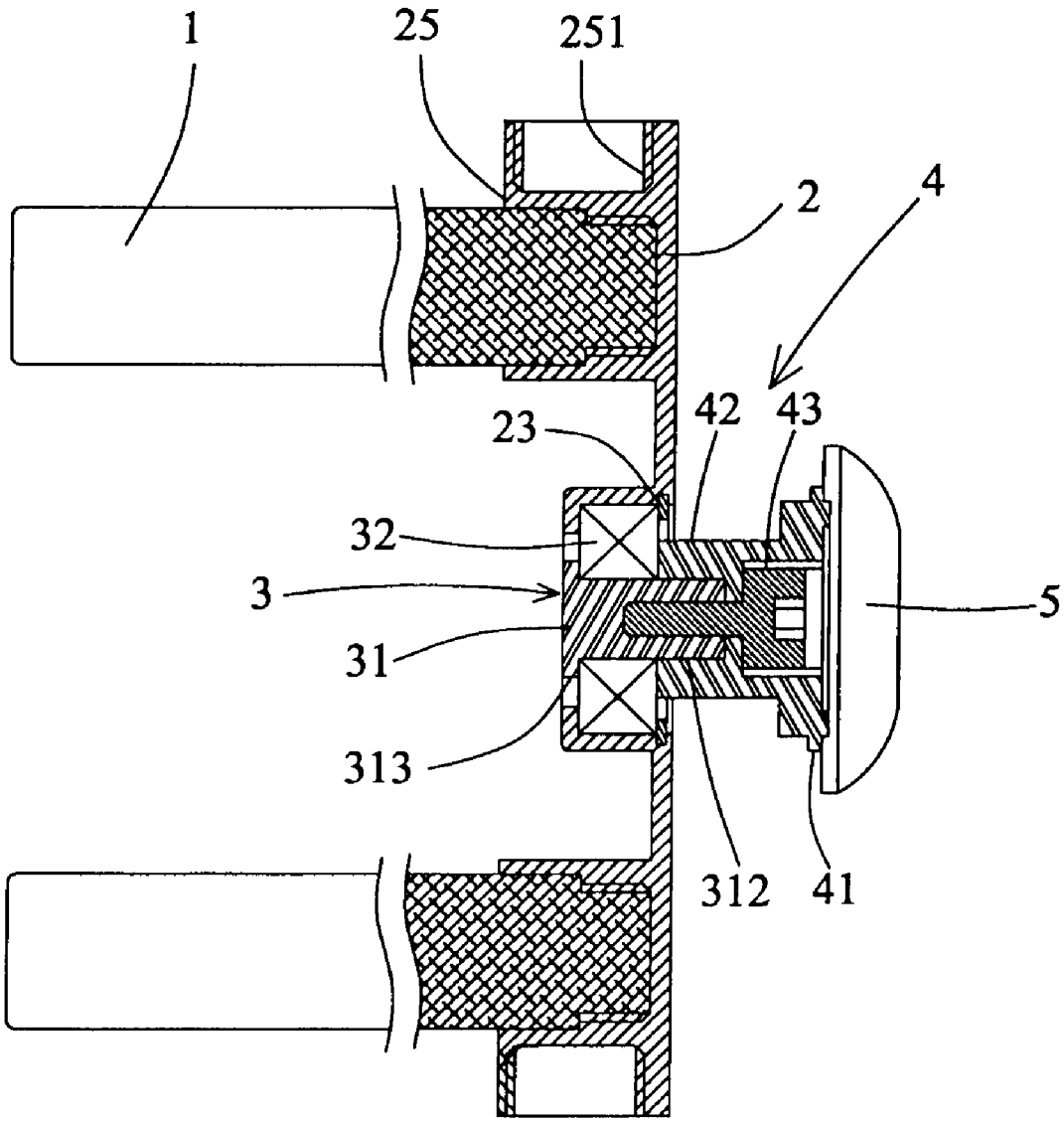
FIG. 6 is a cross sectional view to show a first status of the dumbbell assembly in FIG. 5.
Figure 7:
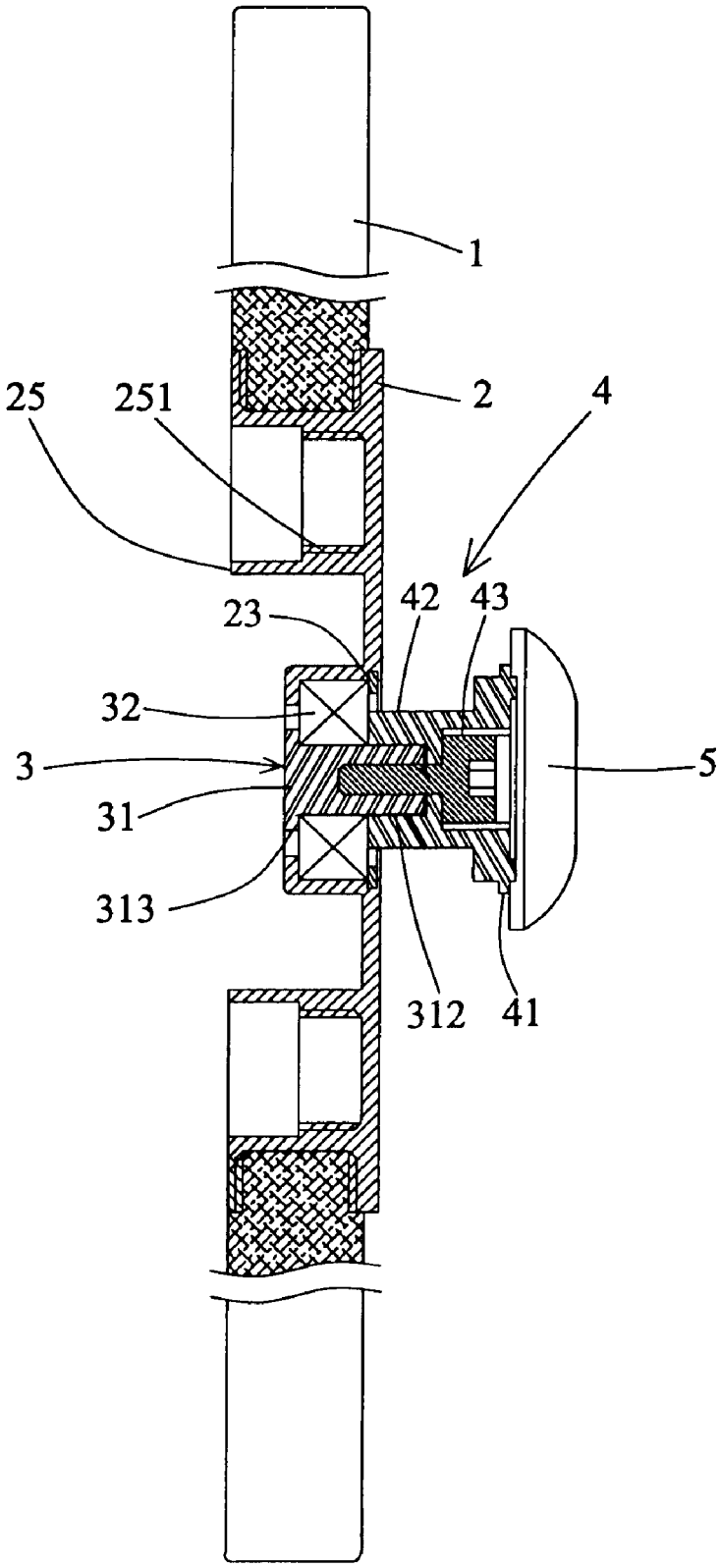
FIG. 7 is a cross sectional view to show a second status of the dumbbell assembly in FIG. 5.
Figure 8:
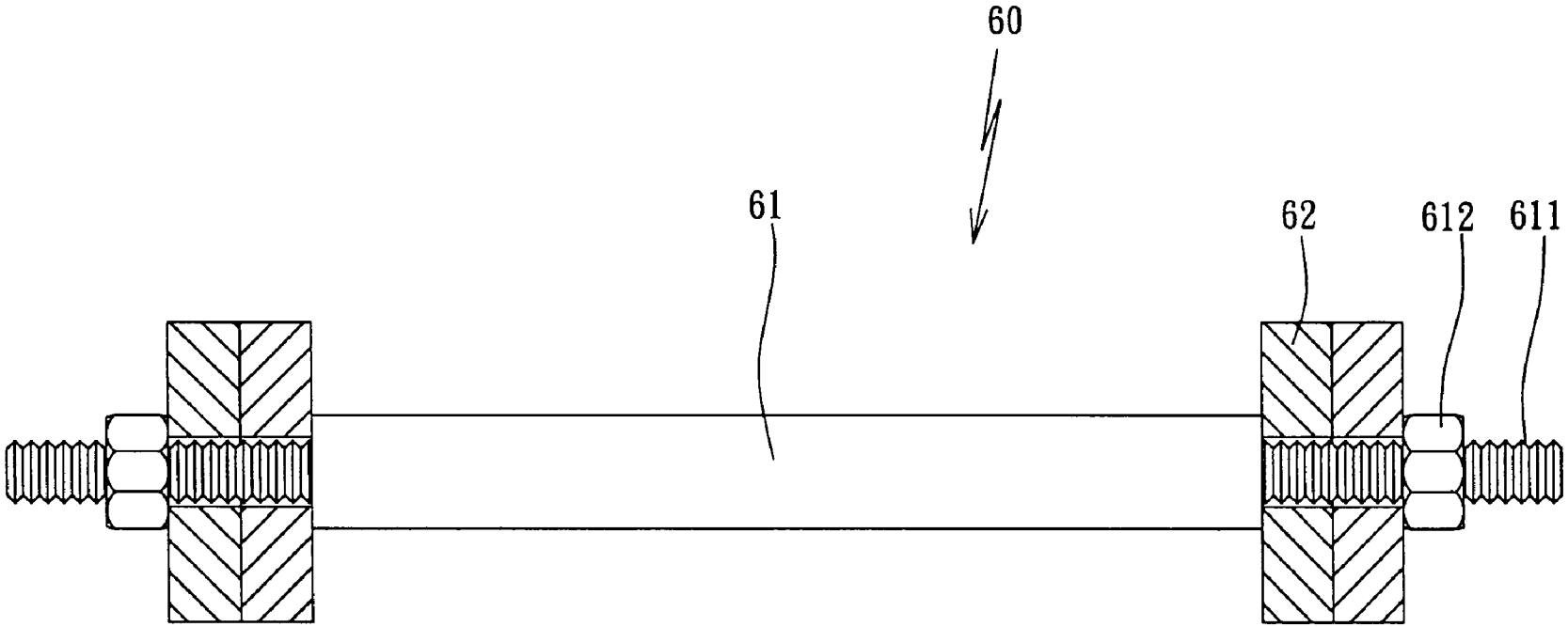
FIG. 8 PRIOR ART
FIG. 8 is a cross sectional view of the conventional dumbbell assembly.

FIG. 5 shows another embodiment of the dumbbell assembly of the present invention, wherein the disk 2 has at least one locking portion 25 and each locking portion 25 has a connection hole 251. Each of the bars 1 has a threaded portion 13 on an end thereof and the threaded portion 13 is threadedly connected to the connection hole 251. The at least one locking portion 25 can be connected to the disk 2 perpendicularly or horizontally. The different ways of connection between the at least one locking portion 25 and the disk 2 provide different functions to exercise different muscles.

While we have shown and described the embodiment in accordance with the present invention, it should be clear to those skilled in the art that further embodiments may be made without departing from the scope of the present invention.

What is claimed is:

1. A dumbbell assembly comprising:

at least one bar;

a disk fixed to the at least one bar and having a reception portion;

a rotatable unit engaged with the reception portion of the disk;

an arm having an insertion on a first end thereof and the insertion mounted to the rotatable unit, the arm having at least one wing, and at least one weight member connected to the at least one wing of the arm.

2. The assembly as claimed in claim 1, wherein the disk includes a through hole and an annular groove defined in an inner periphery of the through hole.

3. The assembly as claimed in claim 2, wherein a rotatable unit connected to the disk and comprises a connector, a bearing and a clip, the connector comprises a tubular portion and a flange extends radially from a first end of the tubular portion, a connection hole is defined in a second end of the tubular portion, the bearing is securely engaged with the through hole of the reception portion of the disk and the tubular portion of the connector securely extends through the bearing, the flange contacts against the bearing, the clip is engaged with the annular groove and positions the bearing.

4. The assembly as claimed in claim 1, wherein the disk has at least one aperture defined therethrough.

5. The assembly as claimed in claim 4, wherein the at least one bar has a connection portion and at least one bolt extends through the at least one aperture of the disk and is securely connected to the connection portion.

6. The assembly as claimed in claim 1, wherein the at least one wing of the arm has at least one engaging hole and the at least one weight member is connected to the at least one engaging hole.

7. The assembly as claimed in claim 1, wherein the disk has at least one locking portion which is perpendicularly connected to the disk.

8. The assembly as claimed in claim 1, wherein the disk has at least one locking portion which is horizontally connected to the disk.

9. The assembly as claimed in claim 7, wherein the at least one bar has a threaded portion on an end thereof and the threaded portion is threadedly connected to the at least one locking portion.

10. The assembly as claimed in claim 8, wherein the at least one bar has a threaded portion on an end thereof and the threaded portion is threadedly connected to the at least one locking portion.

* * * * *